US005420479A

United States Patent [19]

Iida et al.

[11] Patent Number: 5,420,479

[45] Date of Patent: May 30, 1995

[54] HIGH PRESSURE VAPOR DISCHARGE LAMP WITH A BUILT-IN IGNITER

[75] Inventors: Takenobu Iida; Shunichi Sasaki, both of Saitama, Japan

[73] Assignee: Iwasaki Electric Co., Ltd., Tokyo, Japan

[21] Appl. No.: 43,840

[22] Filed: Apr. 7, 1993

[30] Foreign Application Priority Data

Apr. 10, 1992 [JP] Japan ..... 4-116685

[51] Int. Cl.[6] ..... H01J 7/44

[52] U.S. Cl. ..... 315/73; 315/46; 315/309; 315/240

[58] Field of Search ..... 315/74, 289, 309, 73, 315/46, 58, 240

[56] References Cited

U.S. PATENT DOCUMENTS

| | | | |
|---|---|---|---|
| 4,603,281 | 7/1986 | Nilssen | 315/106 |
| 4,742,275 | 5/1988 | Ito et al. | 315/74 |
| 4,987,344 | 1/1991 | Zaslavsky et al. | 315/59 |
| 5,045,757 | 9/1991 | Takenobu et al. | 315/73 |
| 5,138,231 | 8/1992 | Iida et al. | 315/73 |

FOREIGN PATENT DOCUMENTS

| | | |
|---|---|---|
| 60-136152 | 7/1985 | Japan . |
| 3-116687 | 5/1991 | Japan . |
| 1534553 | 1/1990 | U.S.S.R. . |

OTHER PUBLICATIONS

"Metal Halide Lamps Designed for Use With Standard High Pressure Sodium Ballast," *Proceedings of the IES of Australia and New Zealand Inc.,* Shunichi Sasaki et al, 1992, pp. 149–158.

"Ceramic Pulse Generating Capacitor and Built-In Starter for High Pressure Sodium Lamps," *Illuminating Engineering Society of Australia,* Takenobu Iida et al, 1988, pp. 59–65.

*Primary Examiner*—Robert J. Pascal
*Assistant Examiner*—Darius Gambino
*Attorney, Agent, or Firm*—Sughrue, Mion, Zinn, Macpeak & Seas

[57] ABSTRACT

A built-in igniter type high pressure sodium lamp includes an igniter connected in parallel with an arc tube 1 for a high pressure sodium lamp and composed of a series circuit of a thermally-activated bimetal switch 2 and a nonlinear capacitor 3. The high pressure sodium lamp is so constructed that a heating resistor 11 which can heat the nonlinear capacitor 3 to the Curie point temperature when the igniter operates is connected in parallel with and located close to the nonlinear capacitor 3.

8 Claims, 9 Drawing Sheets

HIGH PRESSURE VAPOR DISCHARGE LAMP WITH A BUILT-IN IGNITER

BACKGROUND OF THE INVENTION

1. Field of the Invention

This invention relates to a high pressure vapor discharge lamp which has a built-in igniter using a nonlinear capacitor.

2. Related Art

A conventional igniter for a high pressure vapor discharge lamp including a high voltage pulse generator using a glow lamp has problems such as poor operation stability and short lifetime. Therefore, an igniter using a nonlinear ceramic capacitor has come to be used. Such a nonlinear ceramic capacitor is mainly made of a ferroelectric substance such as barium titanate having nonlinear V-Q characteristics. In this igniter, a pulse voltage is generated every half cycle, by utilizing the saturation characteristics of the nonlinear capacitor and the inductance of a ballast or the like which is connected in series with the nonlinear capacitor. The pulse voltage thus generated is applied to a high pressure vapor discharge lamp, thereby starting it to operate. The construction of a high pressure vapor discharge lamp including such an igniter will be described with reference to FIGS. 1 and 2.

In FIG. 1, reference numeral 1 designates an arc tube for a high pressure sodium lamp, 2 designates a normally-closed thermally-activated bimetal switch, and 3 designates a nonlinear capacitor. The thermally-activated bimetal switch 2 and nonlinear capacitor 3 are connected in series to constitute an igniter which is connected in parallel with the arc tube 1. These components 1, 2 and 3 are housed in an outer bulb 4, thereby constituting a high pressure sodium lamp. Reference numeral 5 designates a ballast such as a choke coil, and 6 designates an AC power source.

Next, the operation of the thus configured high pressure sodium lamp will be described. When the power source 6 is turned on, the voltage of a positive half cycle is applied through the ballast 5 to the nonlinear capacitor 3, so that a charging current flows therethrough. The level of the charging current rapidly drops to zero when the nonlinear capacitor 3 is saturated with electric charges, or when the voltage reaches the saturation voltage of the nonlinear capacitor 3. At this time, the inductance of the ballast 5 causes a high positive pulse voltage to be generated. This pulse voltage and the voltage supplied from the power source are applied to the arc tube 1. Similarly, in the subsequent negative half cycle, a negative pulse voltage is generated. These pulse voltages cause the lamp to start to operate and light up. After the ignition of the lamp, the thermally-activated bimetal switch 2 receives heat from the arc tube 1 to open, thereby disconnecting the igniter from the main circuit.

The configuration of the high pressure sodium lamp having an igniter shown in FIG. 2 is the same as that of the lamp shown in FIG. 1, except that a bidirectional semiconductor diode switch 7 such as an SSS device is connected in series with the nonlinear capacitor 3 of the igniter. The semiconductor switch 7 is not located in the outer bulb 4, but located in a base 20 of the lamp.

The high pressure sodium lamp having the above-described configuration operates as follows: When the AC power source voltage in each cycle exceeds the breakover voltage of the semiconductor switch 7, the nonlinear capacitor 3 is rapidly charged, so that the voltage of the capacitor immediately reaches the saturation voltage, thereby rapidly interrupting the current. This results in the generation of a pulse voltage with a higher peak. Thus, this igniter is suitable for a high wattage lamp.

Such a high pressure vapor discharge lamp with a built-in igniter including a nonlinear capacitor, particularly a high pressure sodium lamp which requires a high ignition voltage, sometimes fails to light up. When such an ignition failure of the lamp once occurs, the built-in igniter continues to generate pulses. This continuous generation of pulses causes the following problems:

(1) Since the coil and core of the ballast are capacitively coupled to each other, the pulse energy generated through the inductance of the ballast leaks out to a metal housing of a lighting fixture in which the ballast is mounted. If the metal housing is not grounded, therefore, the leakage will give an electric shock to a human body.

(2) The pulse voltage is continuously applied to the base of the lamp or the metal part of the lamp holder. This is dangerous to a human body.

(3) The insulation of the ballast, wiring cables and a socket is deteriorated.

(4) A portion of the pulse energy is converted into high-frequency noise to be radiated outside, thereby causing the radio interference in television and radio receivers.

SUMMARY OF THE INVENTION

The invention has been conducted in order to solve the above-mentioned problems of a conventional high pressure vapor discharge lamp with a built-in igniter including a nonlinear capacitor.

An object of the invention is to provide a high pressure vapor discharge lamp with a built-in igniter in which the generation of pulse voltage can be terminated in a short time in the case of the ignition failure of the lamp.

The above object of the invention has been achieved by provision of a high pressure vapor discharge lamp with a built-in igniter including a nonlinear capacitor and connected in parallel with an arc tube, wherein the lamp comprises a heating resistor which is connected in parallel with a circuit including the nonlinear capacitor and which can heat the nonlinear capacitor to the Curie point temperature when the igniter operates, and the heating resistor is located close to the nonlinear capacitor.

In the high pressure vapor discharge lamp configured as described above, when the igniter including the nonlinear capacitor operates but fails to ignite the arc tube, the igniter continues to generate high voltage pulses. In such a case, the temperature of the nonlinear capacitor is raised to/beyond the Curie point temperature in a short time by the heat generated by itself and the heat generated by the heating resistor which is located close to the nonlinear capacitor. Therefore, the generation of high voltage pulses in the case of an ignition failure can be terminated in a short time.

DETAILED DESCRIPTION OF THE PREFERRED EMBODIMENTS

Figure 1:
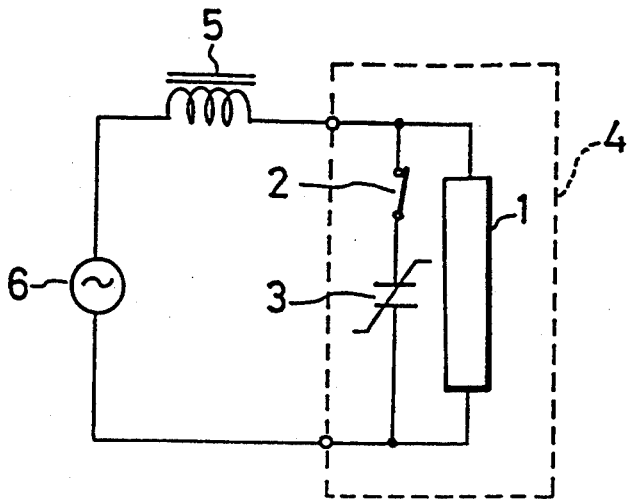
FIG. 1 is a circuit diagram showing the configuration of a conventional high pressure sodium lamp with a built-in igniter.
Figure 3:
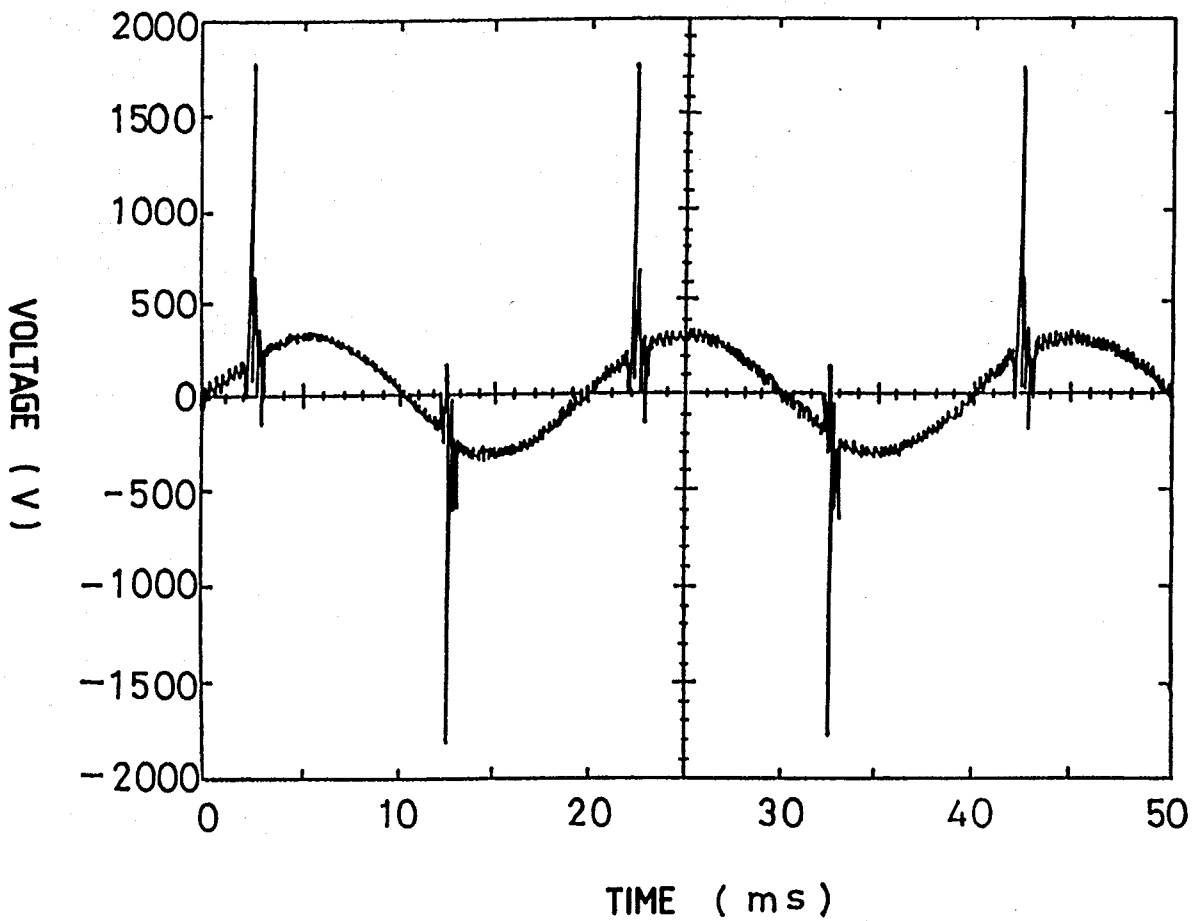
FIG. 3 is a chart showing the waveform of a pulse voltage generated by the built-in igniter before starting a high pressure sodium lamp.
Figure 4:
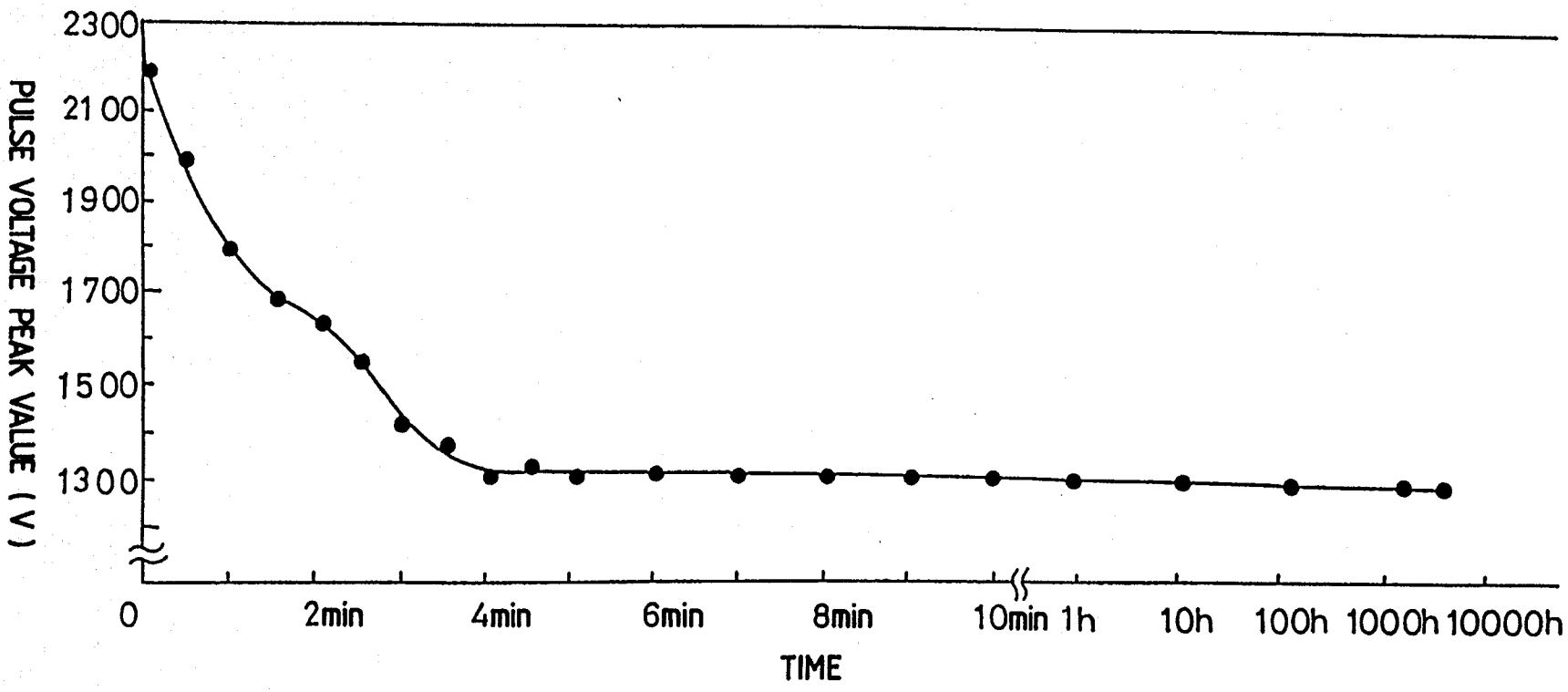
FIG. 4 is a graph showing changes in the peak value of a generated pulse voltage with respect to the elapse of time during the operation of the igniter.

FIG. 3 shows the waveform of a pulse voltage generated when starting the high pressure sodium lamp including the igniter which has the configuration shown in FIG. 1. In this case, the lamp uses a 250-W choke ballast and is driven by a 200-volt AC power source. When the nonlinear capacitor used in this igniter is placed in a vacuum vessel equivalent to the outer bulb of the high pressure sodium lamp, and powered through the same ballast by a 200-volt AC power source, the peak value of the generated pulse voltage decreases with time as shown in FIG. 4. This is because the current flowing through the nonlinear capacitor causes the capacitor itself to generate heat so that the temperature of the capacitor is raised to a value in the vicinity of the Curie point temperature $T_{cp}$ (usually 90° C.), thereby impairing its nonlinear characteristics. Thus, the pulse voltage is gradually lowered with time. When the heat generated by the nonlinear capacitor comes to be in equilibrium with the heat dissipated therefrom, the temperature of the nonlinear capacitor becomes constant, and the pulse voltage also becomes constant at a level which is lower than its initial level by about 40%.

Figure 5:
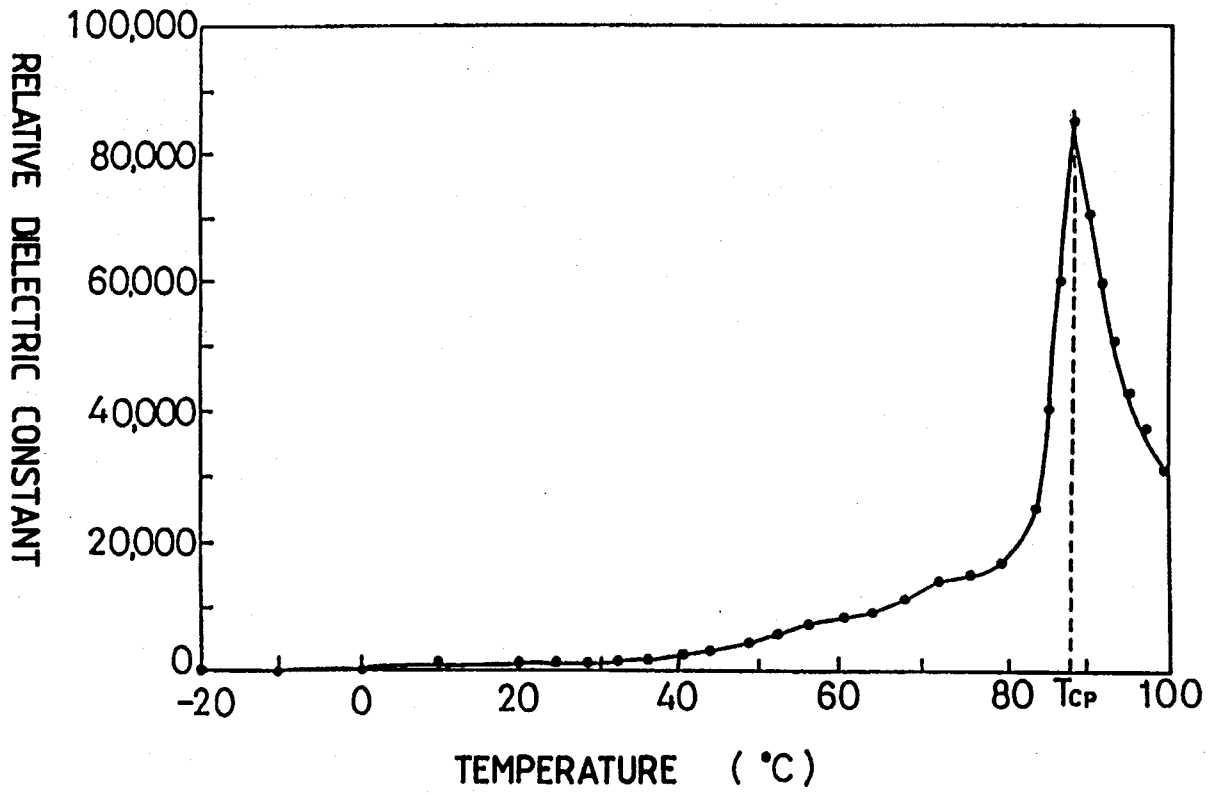
FIG. 5 is a graph showing the relationship between the temperature and relative dielectric constant of the nonlinear capacitor.

The nonlinear capacitor exhibits relative dielectric constant-versus-temperature characteristics as shown in FIG. 5. Below the Curie point temperature $T_{cp}$, the nonlinear capacitor has ferroelectricity and nonlinear characteristics, so that it generates a pulse voltage when connected with an inductive device such as a ballast. In contrast, above the Curie point temperature $T_{cp}$, the nonlinear capacitor is paraelectric and does not exhibit nonlinear characteristics but linear characteristics, so that it has no switching function. Even when connected with an inductive device, therefore, the capacitor does not generate a pulse voltage. In other words, when the temperature of a nonlinear capacitor is raised to the Curie point temperature or higher, it is possible to stop the generation of pulses.

The invention utilizes the above-described phenomenon of the nonlinear capacitor so that the generation of high voltage pulses in the case of an ignition failure can be terminated in a short time.

Figure 6:
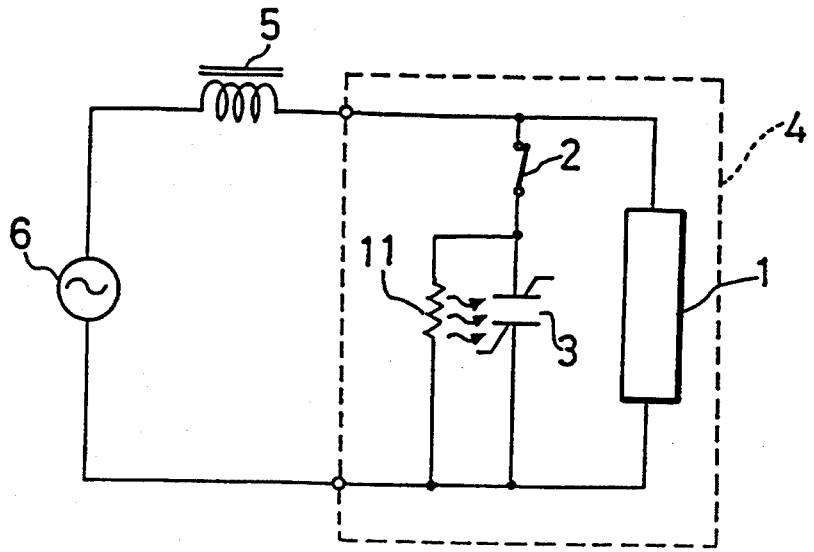
FIG. 6 is a circuit diagram showing a basic embodiment of the high pressure vapor discharge lamp with a built-in igniter according to the invention.

Hereinafter, embodiments of the invention will be described. FIG. 6 is a circuit diagram showing a basic embodiment of the high pressure vapor discharge lamp with a built-in igniter according to the invention. This embodiment has been accomplished by applying the invention to the conventional high pressure sodium lamp shown in FIG. 1. In FIG. 6, the components identical with or corresponding to those of the conventional lamp of FIG. 1 are designated by the same reference numerals. According to the embodiment, the high pressure sodium lamp is so constructed that a heating resistor 11 is connected in parallel with a nonlinear capacitor 3, and located sufficiently close to the nonlinear capacitor 3 so as to heat it to its Curie point temperature.

In the thus configured high pressure sodium lamp, when power is supplied from an AC power source 6 through a ballast 5, a secondary open-circuit voltage of the ballast 5 (when the ballast 5 is a choke coil, the voltage of the power source is applied) is applied to the igniter. The applied voltage causes a charging current to flow through the nonlinear capacitor 3, so that the switching function generates high voltage pulses. The applied voltage causes also a current to flow through the heating resistor 11, so that the resistor generates heat. In the case where the high voltage pulses generated by the combination of the igniter and the ballast fail to ignite the arc tube 1, the high voltage pulses will continue to be generated, and the heat from the heating resistor 11 is conducted to the bulk (substrate) of the nonlinear capacitor 3. This conducted heat is combined with the heat generated by the nonlinear capacitor 3 itself, with the result that the temperature of the capacitor is raised to the Curie point temperature or higher. Therefore, the generation of a pulse voltage can be terminated in a short time.

Figure 2:
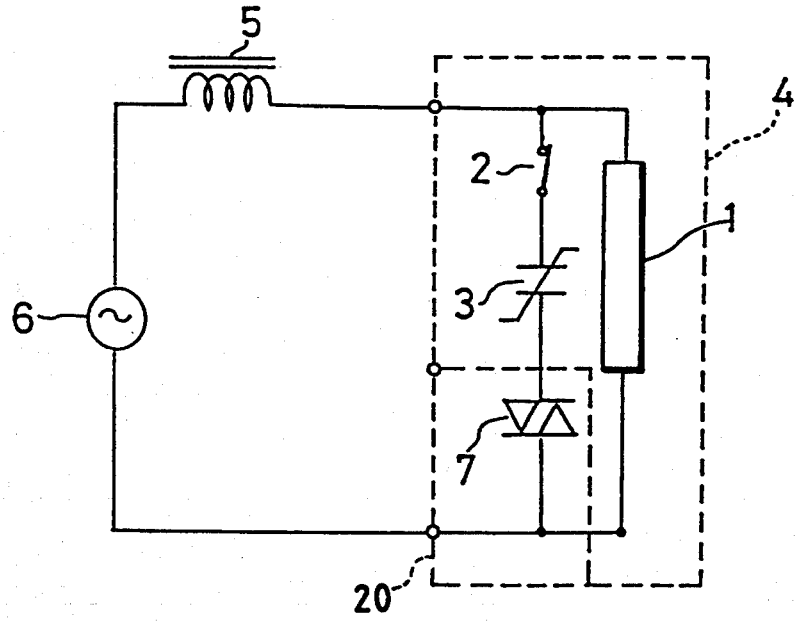
FIG. 2 is a circuit diagram showing the configuration of another conventional high pressure sodium lamp with a built-in igniter.
Figure 7:
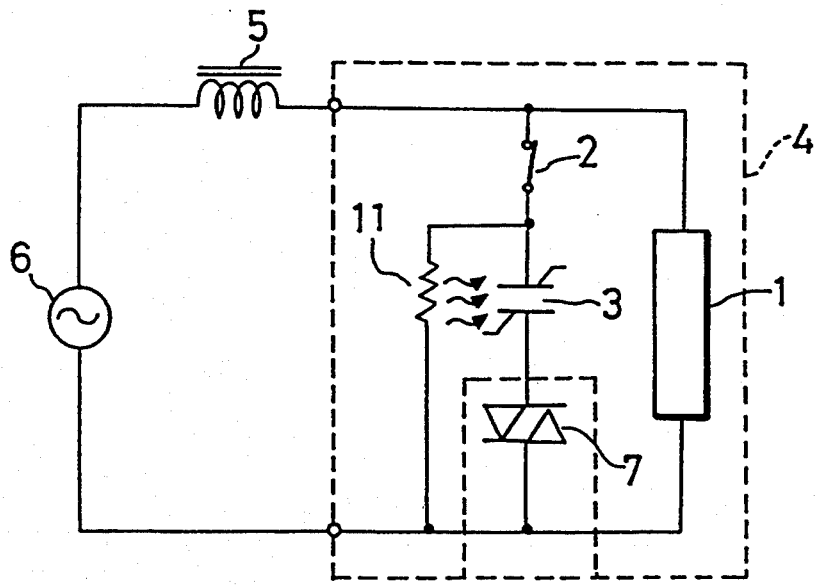
FIG. 7 is a circuit diagram showing a modification of the basic embodiment shown in FIG. 6.

FIG. 7 is a circuit diagram showing an embodiment in which the invention is applied to the conventional high pressure sodium lamp shown in FIG. 2. In FIG. 7, the components identical with or corresponding to those in FIG. 2 are designated by the same reference numerals. In this embodiment, a resistor 11 for heating a nonlinear capacitor 3 is connected in parallel with a series circuit of the nonlinear capacitor 3 and a semiconductor diode switch 7, and the heating resistor 11 is located sufficiently close to the nonlinear capacitor 3 so that the temperature the capacitor is raised to the Curie point temperature. The high pressure sodium lamp having such a configuration operates in the same manner as the above-described basic embodiment shown in FIG. 6, except that a pulse voltage with a higher peak is generated in this high pressure sodium lamp.

Figure 8:
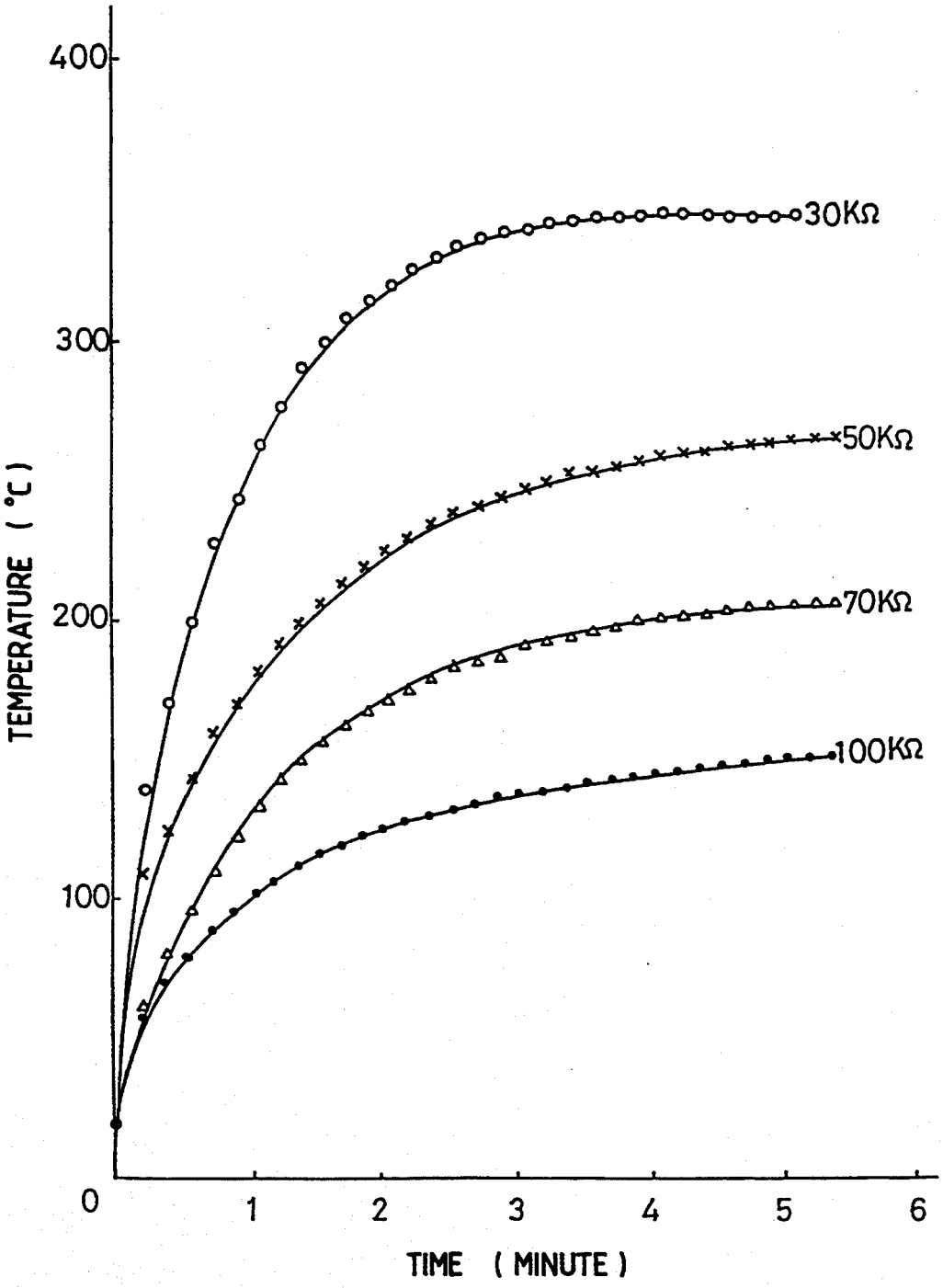
FIG. 8 is a graph showing changes in the surface temperature of carbon film resistors having different resistances, with respect to the elapse of time.

The following describes-experiments which were carried out in order to find an appropriate resistance to be set for the heating resistor. First, ¼ WP-type carbon film resistors having different resistances were placed in a vacuum vessel equivalent to the outer bulb of a high pressure sodium lamp. To each of the resistors, an AC voltage of 50 Hz and 200 volts was applied through a 250-W ballast. The raise of the surface temperature of the terminal base of the resistor was measured. FIG. 8 shows the thus obtained temperature variations of the resistors respectively having the resistances of 30 KΩ, 50 KΩ, 70 KΩ and 100 KΩ.

Figure 9:
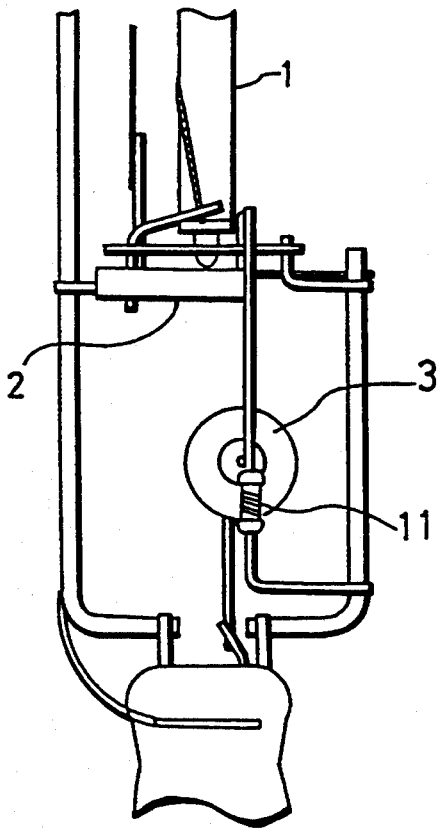
FIG. 9 is a partial side view of the igniter located in the lamp which was used in experiments carried out to determine the resistance of a heating resistor.

Next, high pressure sodium lamps having the configuration of the embodiment of FIG. 7 and respectively including heating resistors 11 of 30 KΩ, 70 KΩ, 80 KΩ and 100 KΩ were prepared in such a manner that each of the resistors 11 was separated by 3 mm from the respective nonlinear capacitor 3. A partial side view of the igniter thus formed is shown in FIG. 9. In each of the lamps, lead wires to the arc tube 1 were cut off, and power was supplied from an AC power source of 50 Hz and 200 volts through a ballast for a 250-W mercury lamp. The peak values of the generated pulse voltage were measured at different points of time until the generation of the pulse voltage ceased. The results shown in FIG. 10 were obtained. As the heating resistors 11, ¼ WP-type carbon film resistors were used. Charcoal wires (made of Ni-plated Fe) with a diameter of 0.9 mm were used as the lead wires.

Figure 10:
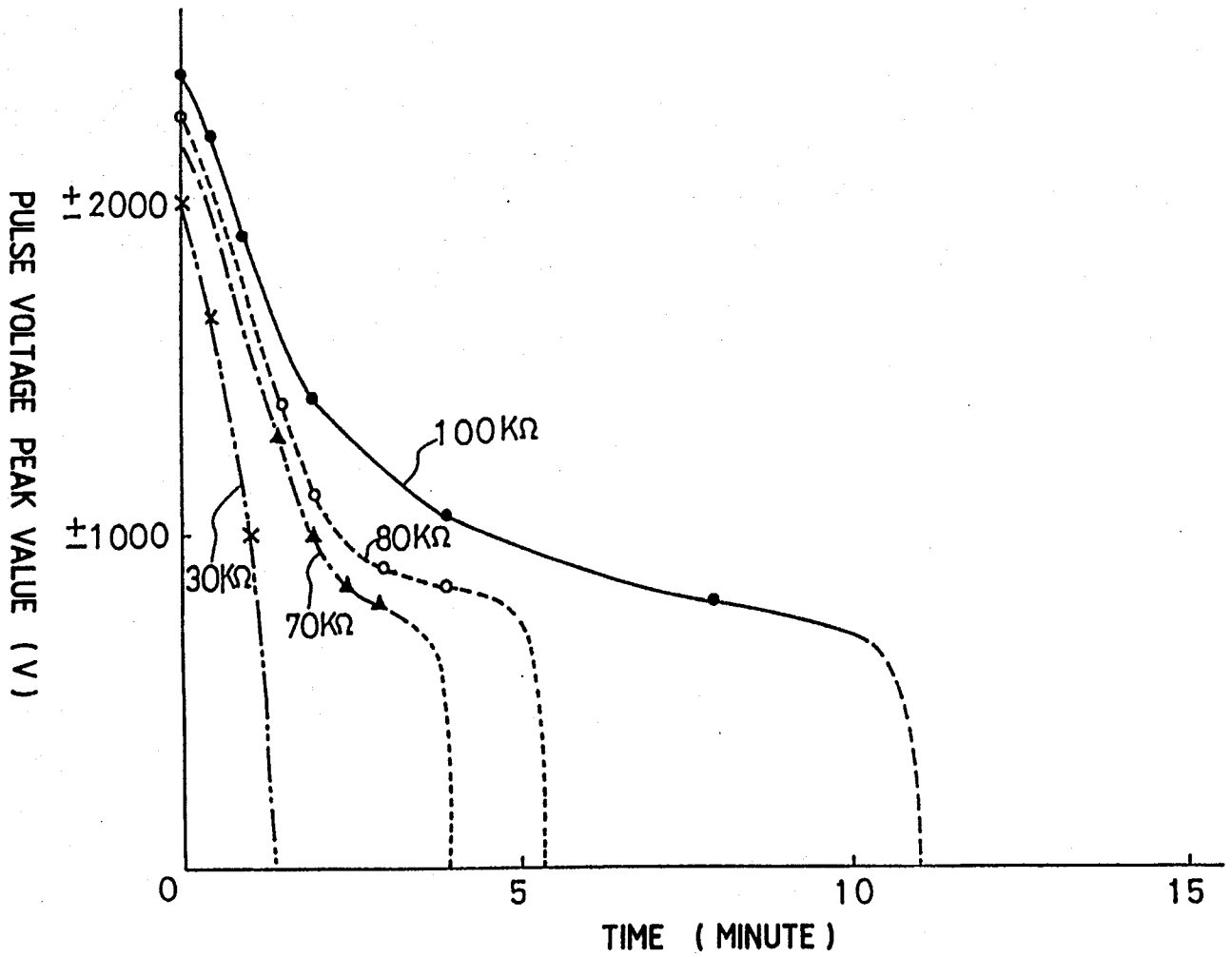
FIG. 10 is a graph showing the relationship between the peak value of pulse voltage and the elapse of time until the pulse generation stops, in cases where heating resistors having different resistances were used.

As can be seen from FIG. 10, the generation of pulses ceases within about 75 seconds when the heating resistor is the resistor of 30 KΩ, within 4 minutes and 50 seconds when the heating resistor is the resistor of 70 KΩ, within 5 minutes and 20 seconds when the heating resistor is the resistor of 80 KΩ, and within about 11 minutes when the heating resistor is the resistor of 100 KΩ. Once the pulse generation ceases, it will never arise again, except when the power is turned off to allow the nonlinear capacitor to be cooled and then turned on again. In the vicinity of the Curie point temperature, the relative dielectric constant of the nonlinear capacitor reaches the maximum level, and therefore the capacitance of the capacitor also reaches its maximum. Accordingly, the current flowing through the nonlinear capacitor also increases to its maximum at this temperature, thereby maximizing the amount of heat generated by the nonlinear capacitor itself. In this case, the semiconductor diode switch remains turned on.

As described above, as the heating resistor has a lower resistance, the pulse generation terminates in a shorter time. Since the heating resistor is connected in parallel with the igniter, however, an extremely low resistance of the heating resistor results in a low level of the generated pulse voltage, thereby causing ignition missing in a normal lamp. Thus, the lower limit of the resistance of the heating resistor is 30 KΩ. When the resistance exceeds 100 KΩ, the generation of a pulse voltage continues for over 11 minutes at room temperature and for a still longer period of time at lower temperatures. Thus, the upper limit of the resistance is practically 100 KΩ. Preferably, the resistance is in the range of 70 KΩ to 80 KΩ.

The above preferable resistance range for the heating resistor is just presented as an example. The resistance is appropriately set depending on the voltage of a power source, the power of a lamp, the location of the heating resistor, etc., so long as the generated pulse voltage is not lowered to such a level as to induce ignition failure and the pulse generation does not continue for a long time.

Figure 11:
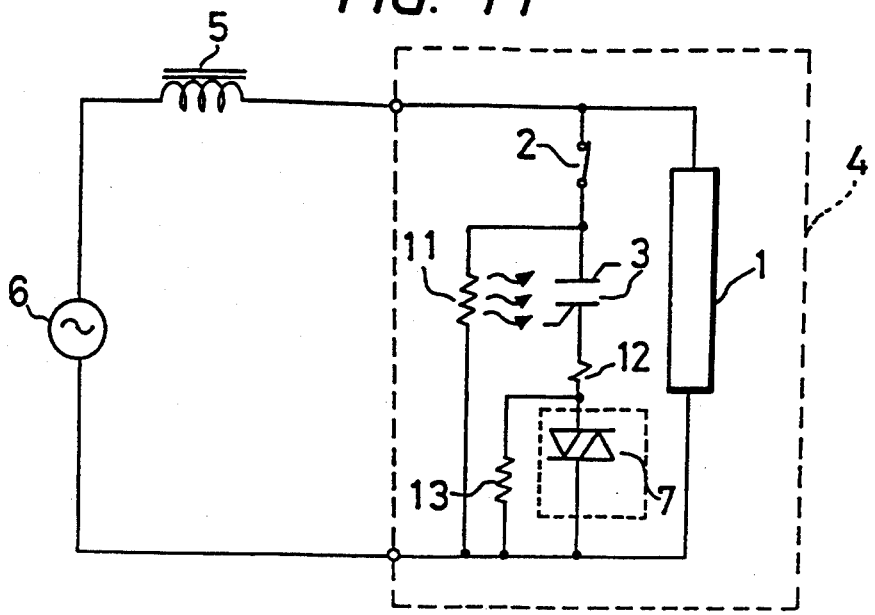
FIG. 11 is a circuit diagram showing a specific embodiment of the invention.
Figure 12:
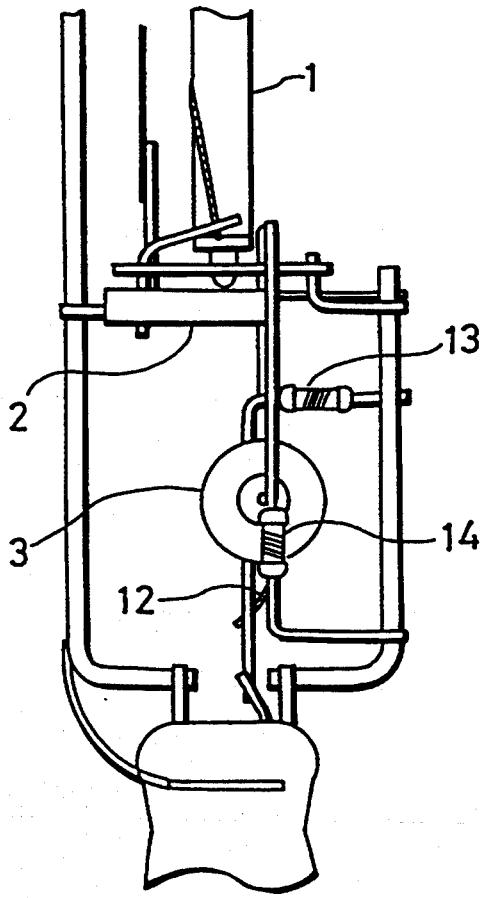
FIG. 12 is a sectional view showing the construction of the main part of the high pressure sodium lamp having the circuit configuration of FIG. 11.

Lastly, a more specific embodiment of the invention will be described. FIG. 11 is a circuit diagram of the embodiment, and FIG. 12 shows the assembly of the igniter and relative devices of the lamp. The circuit configuration of this embodiment is different from that of the embodiment shown in FIG. 7, in that a current damper 12 is connected between a nonlinear capacitor 3 and a semiconductor diode switch 7, and that a resistor 13 for stabilizing the phase of pulse voltage is connected in parallel with the semiconductor diode switch 7. The current damper 12 functions as follows: When xenon gas in the arc tube 1 leaks out into the outer bulb, a discharge sometimes occurs between the electrodes of the nonlinear capacitor. This may result in that the ballast burns out. In the case that such a discharge between the electrodes of the nonlinear capacitor occurs, the current damper 12 burns out to prevent the ballast from burning. The phase-stabilizing resistor functions so that, when the polarity is reversed, the electric charges of the nonlinear capacitor are discharged through the resistor, whereby the phase of generated pulses is prevented from being shifted. In the same manner as in FIGS. 2 and 7, only the semiconductor diode switch 7 is disposed in the base of the lamp.

The nonlinear capacitor 3 used in this embodiment comprises a ferroelectric ceramic substrate of 15.5 mm in diameter and 0.65 mm in thickness, made mainly of barium titanate or the like, and a pair of metal electrode films of 14.5 mm in diameter each formed on each side of the ferroelectric ceramic substrate. As the resistor 11 for heating the nonlinear capacitor, a ¼ WP-type carbon film resistor of 80 KΩ and with charcoal wire leads of 0.9 mm in diameter is used. The heating resistor 11 is positioned 3 mm away from the surface of the nonlinear capacitor 3. The phase-stabilizing resistor 13 is a ¼ WP-type carbon film resistor of 100 KΩ, the semiconductor diode switch 7 is an SSS device with a breakover voltage $V_{BO}$ of 230 V, and the arc tube 1 is an arc tube for a 220-W high pressure sodium lamp. These components constitute the high pressure sodium lamp.

In order to evaluate the characteristics of the thus configured high pressure sodium lamp with respect to the termination of pulse generation, one of the lead wires connected to the electrodes of the arc tube 1 was cut off to simulate the ignition failure of the lamp. A choke coil for a mercury lamp of 250 W, AC 200 V and 50 Hz is used as a ballast In this state, an AC power source voltage of 200 V was applied. As a result, the pulse generation ceased after about 5 minutes and 20 seconds. Then, the voltage was kept applied for another 5,000 hours, to find out whether or not the pulse voltage was generated again. As a result, no pulse voltage generation was observed. This proved that the stop of the pulse generation was surely maintained.

In the embodiments described above, a carbon film resistor was used as the resistor for heating the nonlinear capacitor. The type of the resistor for heating the nonlinear capacitor is not restricted to this, and other types of resistors such as solid resistors and nonlinear resistors may be used.

As described above by reference to the embodiments, according to the invention, the heating resistor which can heat the nonlinear capacitor to the Curie point temperature when the igniter operates is located close to the nonlinear capacitor. Therefore, in the case of ignition failure, the generation of pulse voltage for ignition is allowed to terminate in a short time, thereby assuring safety, suppressing the deterioration in the insulation of the ballast and other components, and preventing the generation of high-frequency noise due to the pulse energy.

What is claimed is:

1. A high pressure vapor discharge lamp with a built-in igniter, comprising:

an arc tube;

a circuit including a nonlinear capacitor connected in parallel with said arc tube; and a heat resistor connected in parallel with said circuit and located close to said nonlinear capacitor, for heating said nonlinear capacitor to at least the Curie point temperature when said arc tube fails to ignite.

2. A high pressure vapor discharge lamp according to claim 1, wherein said igniter comprises a series circuit of said nonlinear capacitor and a semiconductor switch, and said heating resistor is connected in parallel with said series circuit.

3. A high pressure vapor discharge lamp according to claim 2, wherein said semiconductor switch comprises a bidirectional semiconductor diode switch.

4. A high pressure vapor discharge lamp according to claim 1, wherein the resistance of said heating resistor is set in the range of 30 KΩ to 100 KΩ.

5. A high pressure vapor discharge lamp according to claim 1, further comprising a vacuum outer bulb in which said arc tube, said nonlinear capacitor and said heating resistor are disposed.

6. A high pressure vapor discharge lamp according to claim 1, further comprising a ballast connected in series to said igniter and said arc tube.

7. A high pressure vapor discharge lamp according to claim 1, wherein said series circuit further comprises a thermally-activated bimetal switch connected in series with said circuit.

8. A high pressure vapor discharge lamp according to claim 2, further comprising a current damper connected between said nonlinear capacitor and said semiconductor switch, and a stabilizing resistor connected in parallel with said semiconductor switch.

* * * * *